US006546657B2

(12) United States Patent
Gray

(10) Patent No.: US 6,546,657 B2
(45) Date of Patent: Apr. 15, 2003

(54) DOCUMENT DISPLAY HOLDER

(75) Inventor: Richard John Gray, Banbury (GB)

(73) Assignee: Keymite, LTD, Banburry (GB)

( * ) Notice: Subject to any disclaimer, the term of this patent is extended or adjusted under 35 U.S.C. 154(b) by 0 days.

(21) Appl. No.: 10/032,953

(22) Filed: Dec. 27, 2001

(65) Prior Publication Data

US 2002/0104188 A1 Aug. 8, 2002

(30) Foreign Application Priority Data

| | | |
|---|---|---|
| Feb. 3, 2001 | (GB) | 0103093 |
| Feb. 22, 2001 | (GB) | 0104660 |
| Jun. 14, 2001 | (GB) | 0114385 |

(51) Int. Cl.[7] ..... G09F 21/04

(52) U.S. Cl. ..... 40/643; 40/661; 40/649; 40/658; 40/591

(58) Field of Search ..... 40/643, 661, 649, 40/658, 591

(56) References Cited

U.S. PATENT DOCUMENTS

| | | | | | |
|---|---|---|---|---|---|
| 2,696,058 | A | * | 12/1954 | Beyer | 40/643 |
| 5,077,925 | A | * | 1/1992 | Herrera et al. | 40/591 |
| 5,625,969 | A | * | 5/1997 | Vogler | 40/661 |
| 6,253,478 | B1 | * | 7/2001 | Kalavity | 40/658 |
| 6,347,471 | B1 | * | 2/2002 | Mirza | 40/661 |

* cited by examiner

*Primary Examiner*—Gary Hoge
(74) *Attorney, Agent, or Firm*—Paul E Milliken; Ray L Weber

(57) ABSTRACT

A document holder (11) comprising a rigid planar board (21) having one side covered by transparent flexible cover (22), the board (21) and cover (22) at one end being held in a retaining clip (12), said clip (12) comprising a substantially planar tongue (31) with a channel (32) extending along one edge thereof with an opening (34) facing away from the tongue (31).

12 Claims, 2 Drawing Sheets

DOCUMENT DISPLAY HOLDER

FIELD

This invention relates to a document display holder which is usable for displaying advertisements, public notices, warning signs, technical information or similar and is especially for use in cars or commercial vehicles.

BACKGROUND OF THE INVENTION

When displaying vehicles for sale, garages are now required to place notices displaying information relating to specific vehicles on or in proximity to the vehicle. A known method of displaying the information is to place a notice on a lectern near the vehicle. This is expensive since a lectern must be provided adjacent each vehicle.

Other methods of displaying information include placing the notice in a holder affixed to a vehicle window by suckers or a hook which is sandwiched between the top edge of the window and its frame. These method are unsatisfactory in that the holder may fall from the windows.

The present invention provides a cheap re-usable document holder which is readily usable within a vehicle.

STATEMENTS OF INVENTION

According to one aspect of the present invention there is provided a document holder comprising a rigid planar board having one side covered by transparent flexible cover, the board and cover at one end being held in a retaining clip, said clip comprising a substantially planar tongue with a channel extending along one edge thereof with the opening facing away from the tongue, with said one end being held in the channel.

The transparent cover material is a thin transparent plastics material about 0.010 inches (0.25 mm) thick such as PET, or polycarbonate. The cover is preferably wrapped around said one end of the board with a rear portion covering the bottom edge margin of the rear of the board.

The clip may be formed from a thermoplastics material which is rigid and has good temperature resistance for example polycarbonate. The channel is a U-shaped channel and preferably the tongue is substantially aligned with one limb of the U shaped channel, preferably the front limb, and the tongue may be tapered being thinnest at its distal end away from the channel. The other limb, or portion thereof, of the "U shaped channel may extend further from the base of the channel than said one leg. At least one of the limbs may have a retaining means on its inner surface, for example adhesive and/or a retaining bead.

The tongue may be inclined forwardly relative the channel, preferably at an angle of between 10–30 degrees.

The rear surface of the tongue may have a retention bead formed thereon.

The document holder may comprise an envelope having a flat sleeve-like body including the rigid planar board having one side covered by transparent sheet material wrapped around the board, said one end of the body being retained in the clip with its other having an opening for insertion and removal of a document into and from the body.

The transparent sheet material is preferably made from a transparent plastics material such as PET (polyethyleneterapthallate), polyvinyl chloride, polyvinylidene chloride, nylon etc. and is conveniently wrapped around the rigid board and fixed to its other side by adhesive.

The board may comprise one of rigid paper, cardboard or plastics sheet, ABS sheet (Acrylonitrilebutadienestyrene) about 0.125 inches (3.0 mm) thick or a relatively lightweight twin flute plastics sheet sold under the trade name Corex. Preferably the board is rectangular conveniently accommodating A3 or A4 sheet.

The cover and board may be held in place in the clip by fasteners, preferably rivets which pass through the rear limb of the channel and through the rear portion of the cover and bottom edge margin of the sheet only.

DESCRIPTION OF THE DRAWINGS

The invention will be described by way of example and with reference to the accompanying drawings in which.

DETAILED DESCRIPTION OF THE INVENTION

Figure 1:
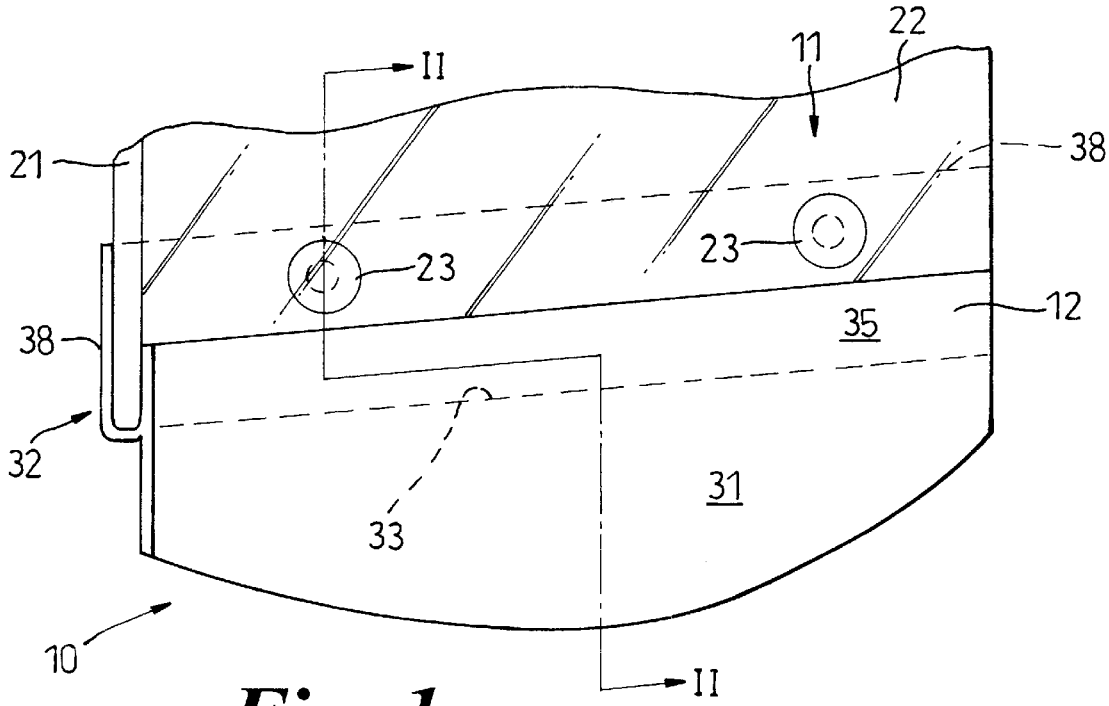
FIG. 1 is an isometric view of a document holder according to the present invention.
Figure 2:
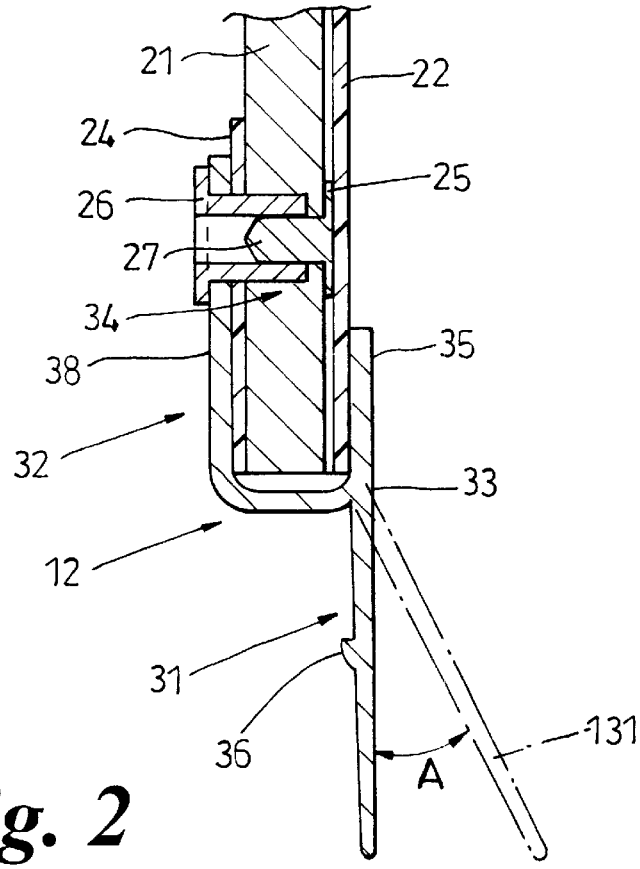
FIG. 2 is section of the envelope and clip taken on the line II—II of FIG. 1.

With reference to FIGS. 1 & 2, there is shown a document holder 10 which comprises a folder 11 and a clip 12. The folder 11 is formed from a rigid planar board or sheet 21 having a transparent cover material 22 overlaying the board 21. The transparent sheet 22 covers the front of the board and has a lower portion 24 that extend around the bottom edge of the board and covers the rear bottom edge margin thereof.

The transparent sheet material 22 is formed from a flexible plastic sheet material such as polyethyleneterephthallate sheet (PET), PVC sheet, polycarbonate, about 0.25 mm (0.010 ins) thick and the board 21 is preferably a sheet of rigid plastics material, preferably ABS about 3 mm (0.125 ins.) thick.

Conveniently the folder 11 is dimensioned to receive A3 or A4 size sheets.

The lower end of the folder 11 is held by the clip 12 which is made from a thermoplastics material such as nylon or polypropylene. The clip 12 comprises a substantially planar tongue 31 which may be any desired shape and which has a channel 32 extending along its upper edge 33. The channel 32 has its mouth 34 facing away from the tongue 31 and has two limbs 35 and 38 which can accommodate the lower edge of a folder 11 inserted therebetween. The back limb 38 is typically higher than the front limb 35. The channel 32 may extend for upto full width of the folder 11.

The folder is held in the clip by two spaced apart fasteners, preferably rivets 23, which pass through aligned holes in the back limb 38, the rear portion 24 of cover 22, and the board 21. The head 25 at one end of the rivet is located between the front cover and the board 21 spacing the lower potion of the cover from the front face of the board. The rivets 23 may be formed from plastic and be in two interengaging parts 26, 27 inserted into the aligned holes from opposite side of the board 21.

The tongue 31 is centered on the mid length of the channel 32 and is preferably a short broad tongue having a length of less than 50% of its width. The width of the tongue may be 30–100% of the length of the channel. The front surface of the tongue 31 is preferably aligned with the front limb 35 of the channel 32 and is tapered in thickness away from the channel 32 being thinnest at its distal end. The rear surface of the tongue may have a retaining rib or bead 36 thereon. The clip may alternatively be provided with an inclined tongue 131 which may be forwardly relative to the channel 32 at angle of inclination A of between 5–30 degrees of arc as shown in dotted outline.

The document holder 10 can have a display item inserted between the cover 22 and board 21. The holder is preferably for use on the inside of a vehicle adjacent a door window or windscreen. The holder is utilised by inserting the tongue down between the window glass and the decorative or weather strip along the top of the inner window sill or between a facia panel and windsceen. The tongue when inserted for its full depth holds the front 29 of the envelope very close to the vehicle window. The bead 36 may prevent the holder from accidently falling from its location and the holder is sufficiently light in weight and has sufficient rigidity to remain upright in position and not to be dislodged by opening and closing of a car door.

The inclined tongue 131 version shown in FIG. 2 holds the folder 11 closer to the window glass.

The holder 10 may be supplied in the form a kit from which a document holder can be made. In this state the clip, cover 22, board 21 and rivets 23 are supplied as discrete components for assembly into the document holder 10.

Figure 3:
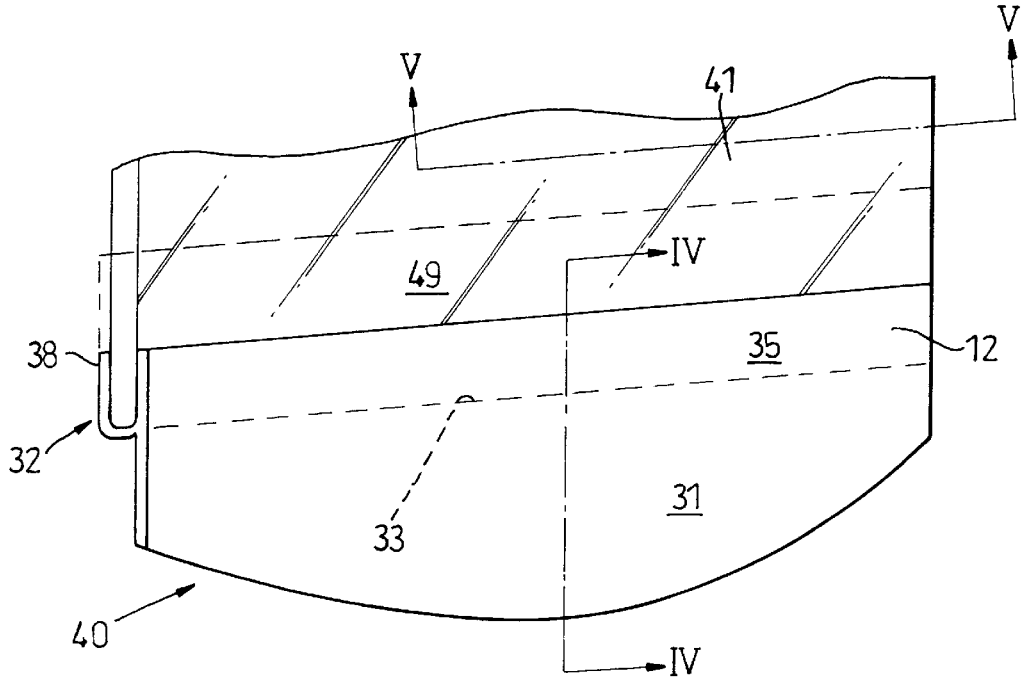
FIG. 3 is an isometric view of a second document holder also according to the present invention.
Figure 4:
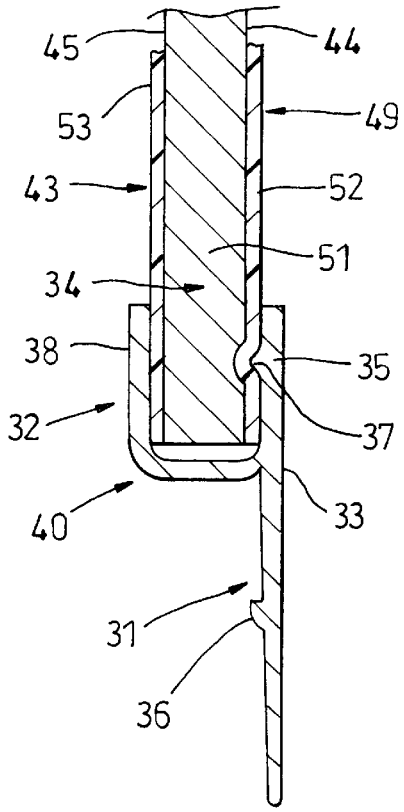
FIG. 4 is section of the envelope and clip taken on the line IV—IV of FIG. 3.
Figure 5:
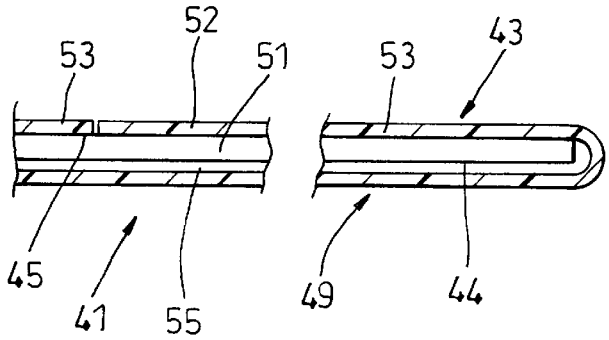
FIG. 5 is a section through the envelope taken on the line V—V of FIG. 3.

With reference to FIGS. 3 to 5, there is shown a document holder 40 which comprises an envelope 41 and a clip 12. The clip is similar to that of FIG. 1 and the same reference numerals will be used where appropriate. The envelope 41 has a sleeve-like body 43 formed from a rigid planar board or sheet 51 having a transparent sheet material 52 wrapped around the board. The transparent sheet 52 covers the front 44 of the board and has portions 53 that extend around the peripheral edges of the board and are fixed to its rear surface 45 by adhesive.

A pocket 55 is formed between the front surface 44 of the board 51 and the transparent sheet material 52. The pocket 25 has a transparent front 49 and is open at its upper end (not shown) and its lower end is closed by the clip 12.

Conveniently the envelope 41 is dimensioned to receive A3 or A4 size sheets.

The transparent sheet material 52 is formed a from flexible plastic sheet material such as polethyleneterephthallate sheet, PVC sheet, polyethylene sheet etc. The board 51 is preferably a sheet of rigid plastics material, preferably a light weight cellular material, for example, a twin flute corrugated material sold under the name Corex.

The clip 12 is made from a clear theromplastics material such as polycarbonate and comprises a substantially planar tongue 31 which may be any desired shape and which has a channel 32 extending along its upper edge 33. The channel may have a low front ledge, but is preferably a "U" shaped channel with the mouth 34 of the channel 32 facing away from the tongue 31. The two limbs 35 and 38 of the channel accommodate the lower edge of an envelope 41 inserted therebetween. The back limb 38 is typically higher than the front limb 35.

The channel 32 may also be provided with a retaining rib 37 on the inner surface of either or both limbs 35 or 38 to help retain the lower end portion of the envelope 41 in the clip. The rear limb 38, or a portion thereof, extends upwardly to be several times higher than the front limb 35, thereby providing additional support at the rear of the envelope 11.

The tongue 31 is substantially as previously described.

The document holder 40 can have a display item inserted into the pocket 55 through the open upper end. The holder is preferably for use on the inside of a vehicle adjacent a door window or windscreen as previously described herein.

If the holder is used for external display the upper end of the pocket may be closed by a flap which may be sealable using a low tack adhesive which can preferably stand repeat usage.

The holder 40 may be supplied in the form of a kit from which a document holder can be made. In this state the clip and envelope are supplied as discrete components for assembly into the document holder 40.

What is claimed is:

1. A document holder comprising a rigid planar board having one side covered by transparent flexible cover, the board and cover at one end being held in a retaining clip, said clip comprising a substantially planar tongue with a channel extending along one edge thereof, the channel having a front limb and rear limb and an opening facing away from the tongue, with said one end being held in the channel.

2. A holder as claimed in claim 1 wherein the cover is wrapped around said one end of the board with a rear portion covering the bottom edge margin of the rear of the board.

3. A holder as claimed in claim 2 wherein said one end is held in place in the channel by fasteners.

4. A holder as claimed in claim 3 wherein the fasteners comprise rivets which pass through the rear limb of the channel and through the rear portion of the cover and bottom edge margin of the sheet only.

5. A holder as claimed in claim 1 and comprising an envelope having a flat sleeve-like body including the rigid planar board and having one side covered by transparent sheet material, said one end of the body being retained in the channel with its other having an opening for insertion of a document into the body.

6. A holder as claimed in claim 1, wherein the channel on the clip is substantially "U" shaped.

7. A holder as claimed in claim 1 wherein the tongue is substantially aligned with one leg of the channel.

8. A holder as claimed in claim 7 wherein the tongue is tapered being thinnest at its distal end.

9. A holder as claimed in claim 7 wherein the tongue is inclined forwardly relative the channel at an angle of between 10–30 degrees.

10. A holder as claimed in claim 7 wherein the rear surface of the tongue has a retention bead formed thereon.

11. A holder as claimed in claim 6 wherein at least one leg of the U shaped channel has a retaining means on its inner surface.

12. A bolder as claimed in claim 2 wherein said one end of the folder is held in place in the channel by adhesive, the tongue is substantially aligned with the front limb of the channel, is thinnest at its distal end, and is inclined forwardly relative to the channel at an angle of between 5–30 degrees of arc.

* * * * *